US005077982A

United States Patent [19]

Shaffer, Jr.

[11] Patent Number: 5,077,982

[45] Date of Patent: Jan. 7, 1992

[54] MULTIZONE AIR CONDITIONING SYSTEM AND EVAPORATORS THEREFOR

[75] Inventor: Jacob E. Shaffer, Jr., Albuquerque, N. Mex.

[73] Assignee: York International Corporation, York, Pa.

[21] Appl. No.: 479,970

[22] Filed: Feb. 14, 1990

[51] Int. Cl.[5] ..... F25B 5/02

[52] U.S. Cl. ..... 62/199; 62/174; 62/206; 62/228.5

[58] Field of Search ..... 62/199, 200, 228.1, 62/228.4, 228.5, 174, 504, 525, 206, 205

[56] References Cited

U.S. PATENT DOCUMENTS

| | | | |
|---|---|---|---|
| 2,237,261 | 4/1941 | McGrath | 62/200 X |
| 2,978,877 | 4/1961 | Long | 62/155 |
| 3,065,610 | 11/1962 | Maudlin | 62/149 |
| 3,643,460 | 2/1972 | Garland | 62/174 |
| 3,797,265 | 3/1974 | Garland | 62/174 |
| 3,866,439 | 2/1975 | Bussjager et al. | 62/504 |
| 4,123,914 | 11/1978 | Perez et al. | 62/196 |
| 4,253,225 | 3/1981 | Wright et al. | 29/157.3 |
| 4,620,423 | 11/1986 | Hopkinson et al. | 62/77 |
| 4,643,002 | 2/1987 | Dennis et al. | 62/525 |
| 4,748,822 | 6/1988 | Erbs et al. | 62/213 |
| 4,760,707 | 8/1988 | Dennis et al. | 62/197 |
| 4,766,735 | 8/1988 | Gotou | 62/199 X |

*Primary Examiner*—Harry B. Tanner

*Attorney, Agent, or Firm*—Finnegan, Henderson, Farabow, Garrett & Dunner

[57] ABSTRACT

A multizone air conditioning system for cooling multiple zones by circulating refrigerant in a closed circuit through the system. The system includes control means for activating and deactivating at least one individual evaporator unit and means for retaining within the portion of the tubing of an individual evaporator unit, when and if it deactivated, an amount of refrigerant which is approximately equal to the amount of refrigerant in the individual evaporator unit when it is activated. As a result, the refrigerant in the system remains balanced regardless of whether individual evaporator units are activated or deactivated.

14 Claims, 3 Drawing Sheets

MULTIZONE AIR CONDITIONING SYSTEM AND EVAPORATORS THEREFOR

BACKGROUND OF THE INVENTION

A. Field of the Invention

The present invention relates to a multizone air conditioning system having a plurality of individual evaporator units and more particularly to a system and evaporator units which provide a balanced charge of refrigerant in the system, regardless of whether individual units are activated or deactivated at a given time.

B. Description of the Prior Art

Multizone air conditioning and heat pump systems have been used to provide individual heating or cooling to separate zones within the system. Such systems typically include a single outdoor compressor and a plurality of individual evaporator units, which cool or heat the zones in which they are located. Examples of such systems are described in U.S. Pat. Nos. 2,978,877 to Long; 3,797,265 to Garland; 4,620,423 to Hopkinson et al.; 4,643,002 to Dennis et al.; and 4,760,707 to Dennis et al.

The use of multizone systems is becoming popular where it is desirable to control the environment in individual rooms such as in residential and light commercial applications. In such systems, fewer than all of the evaporator units and associated fans in the individual rooms may be in active operation at any given time. When less than all evaporator units are active, the system will become unbalanced both in terms of capacity of the outdoor and indoor units, and in terms of the refrigerant in the system.

Many of these systems, such as the system disclosed in Long, Garland, and Dennis et al., require use of complex bleed-off systems, holding tanks, or accumulators to attempt to balance the refrigerant charge within the multizone system. For example, the recently issued '707 to Dennis et al. explains that one approach to solve these problems is to provide bleed-off valves between the high and low sides of the system. Such bleed-off valves are opened to allow a portion of the liquid refrigerant to flash over to the low pressure side. Dennis et al. discloses the use of a bleedoff valve 81 and also includes a thermocharger 82 with associated temperature sensor and check valves to subcool liquid refrigerant passing through a heat exchanger in the thermocharger 82, to thereby increase the efficiency of the system. Dennis et al. also includes an accumulator 34 to hold refrigerant.

The complex systems disclosed in the prior art add appreciably to the costs of the systems. The complexity also often results in a decrease in the efficiency of the system.

SUMMARY OF THE INVENTION

It is an object of the present invention to provide a multizone air conditioning system which provides improved operational characteristics and is more economical than the prior systems.

Another object of the present invention is to provide a multizone air conditioning system which eliminates the need for a complex redistribution system of refrigerant, when one or more evaporator units are deactivated.

Another object is to provide an evaporator unit for a multizone air conditioning system which when added to the system provides for a balancing of the refrigerant in the system, regardless of whether the evaporator unit is active or deactive.

An additional object is to provide a multizone air conditioning system which promotes efficiency and is economical.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a multizone air conditioning system for cooling multiple zones by circulating refrigerant in a closed circuit through the system, the system comprising: at least one condensing unit containing a compressor and a condenser for condensing the refrigerant from a vapor to a liquid refrigerant, the condenser being in fluid connection with and downstream from the compressor; a plurality of evaporator units placed in parallel relationship with one another in the circuit and in fluid connection with and downstream from the condenser; each individual evaporator unit including at least one expansion device, tubing downstream from the expansion device, and an output end in fluid connection with the the compressor; control means for activating and deactivating at least one individual evaporator unit so that refrigerant flows through the evaporator when it is activated and does not flow through the evaporator when it is deactivated; and means for retaining within a portion of the tubing of an individual evaporator, when and if it is deactivated, an amount of refrigerant that is approximately equal to the amount of refrigerant in the individual evaporator unit when it is activated, whereby the refrigerant in each individual evaporator unit in the system remains essentially the same regardless of whether individual evaporator units are activated or deactivated.

The invention, as embodied and broadly described herein, also comprises an evaporator unit for use in a multizone air conditioner system when it is in active operation, the evaporator unit comprising at least one expansion device, an evaporator coil downstream of and in fluid communication with the expansion device, and a valve placed in the tubing of the evaporator coil at a position intermediate the length of the tubing for retaining within the portion of the tubing downstream of the expansion device and upstream of the valve an amount of refrigerant that is approximately equal to the amount of refrigerant which will occupy the evaporator when it is in active operation in the multizone air conditioning system.

It is to be understood that both the foregoing general description and the following detailed description are exemplary and explanatory only are not restrictive of the invention, as claimed.

The accompanying drawings, which are incorporated in and constitute a part of this specification, illustrate several embodiments of the invention and together with the description serve to explain the principles of the invention.

DESCRIPTION OF THE PREFERRED EMBODIMENTS

Reference will now be made in detail to the present preferred embodiments of the invention, examples of which are illustrated in the accompanying drawings. Wherever possible, the same reference numbers will be used throughout the drawings to refer to same or like parts.

Figure 1:
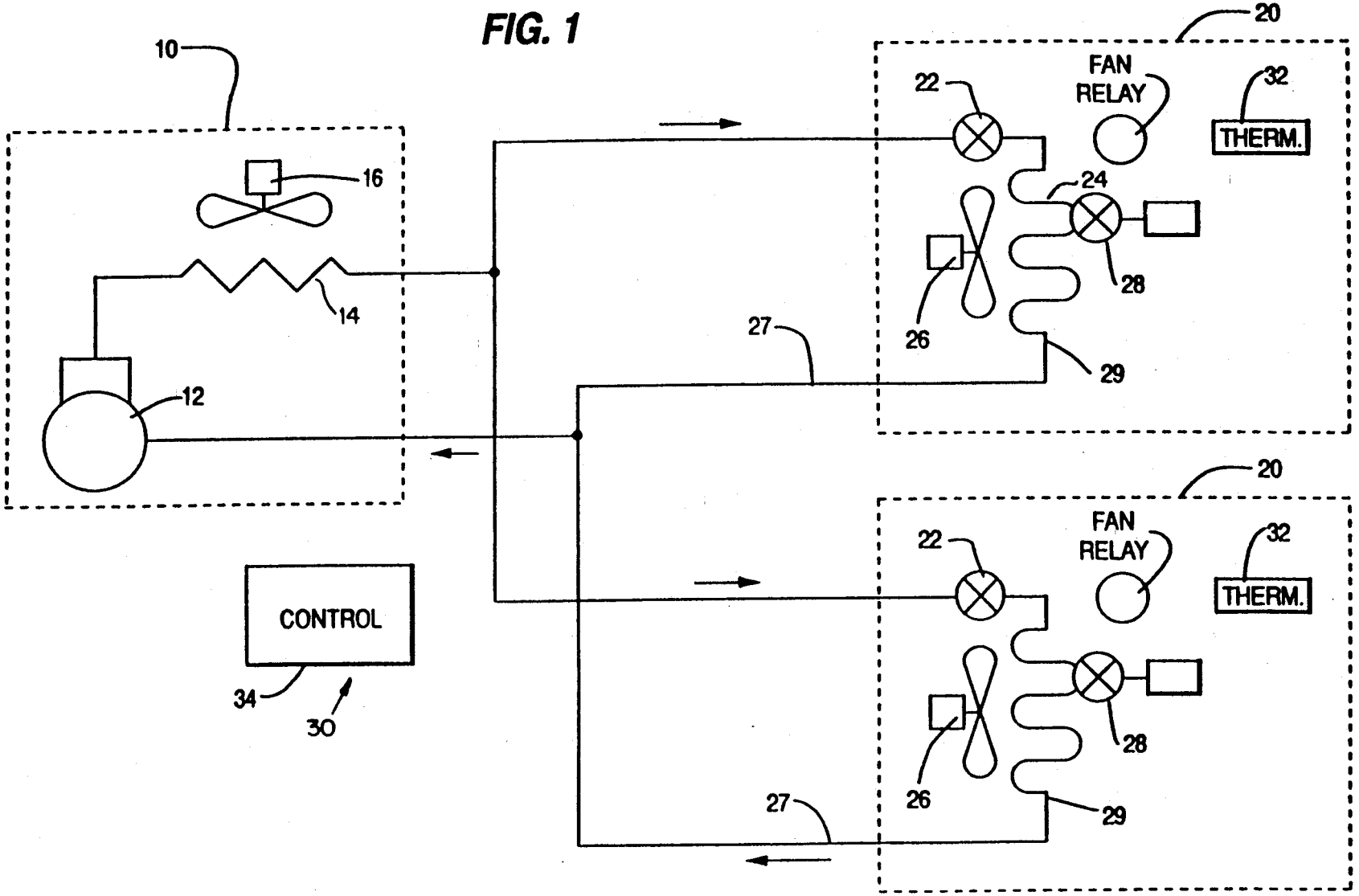
FIG. 1 is a schematic illustration of a first embodiment of a multizone air conditioning system according to the present invention.

As shown in FIG. 1, the multizone air conditioning system of the present invention includes an outdoor section 10, a plurality of indoor units 20 and a control section 30. The multizone system is designed to be installed in a building or a section of a building where it is desired to have independent control and operation of the individual indoor air conditioning units 20 within various rooms of the building, or sections of a refrigeration system. In the embodiment shown in FIG. 1, only two individual units in parallel are shown, although the system can include as many parallel units as are desired. Thus, by means of example only, FIG. 2 schematically shows a system in which three individual units are in parallel.

Figure 2:
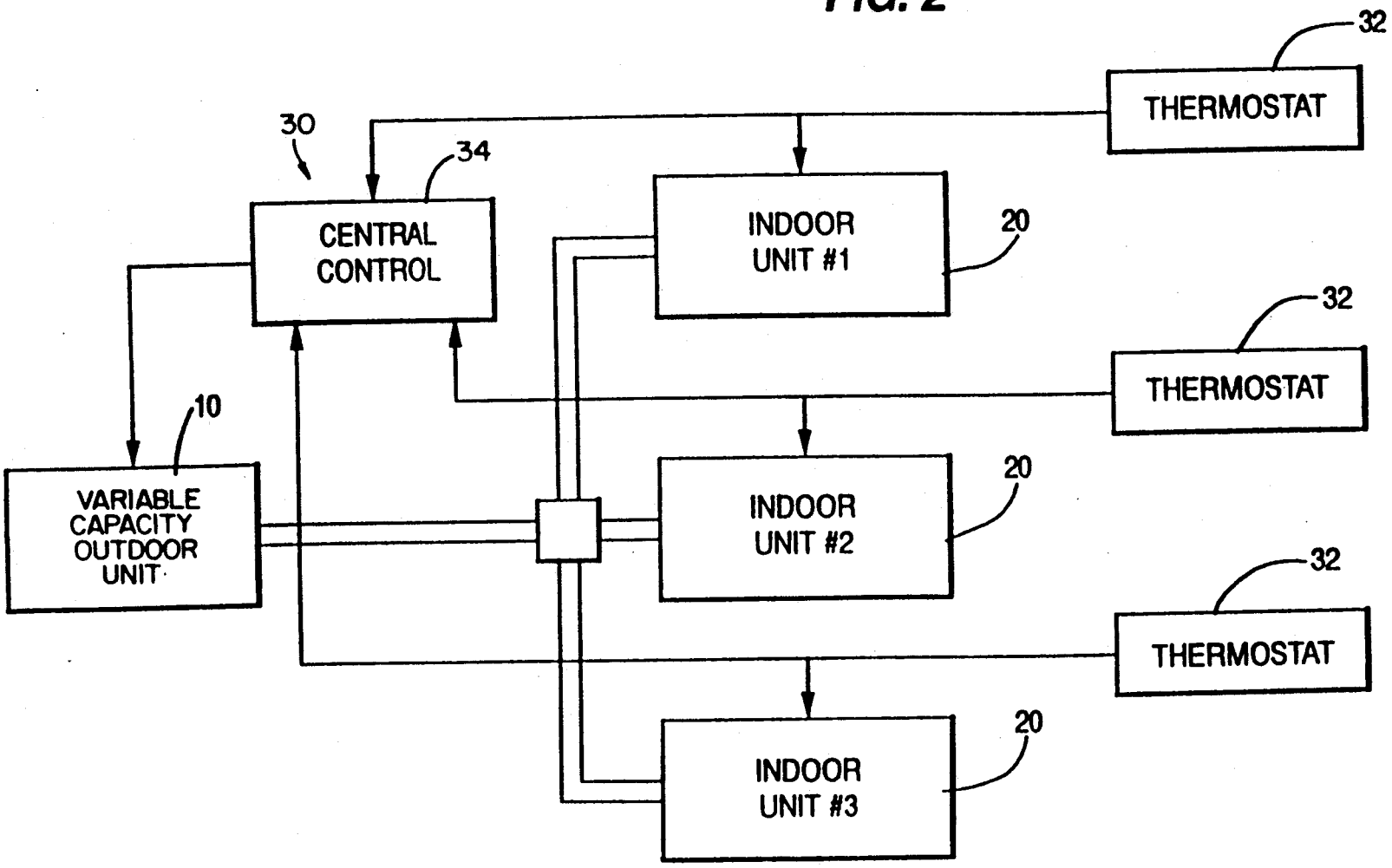
FIG. 2 is a schematic illustration of a second embodiment of the present invention.

As shown in both FIGS. 1 and 2, each of the individual units has its own thermostat 32 which is located in the respective rooms, and the system is operated to provide the cooling of the respective rooms as required to meet the demands indicated by the respective thermostats. Thus, at any time all of the individual units 20 may be operating simultaneously, or one may be operating while the other or others are turned off. The outdoor unit 10 is of a conventional design and includes a compressor 12, a condenser coil 14, and a fan and drive motor 16. The components of the outdoor section are sized so that they have sufficient capacity to service all of the individual evaporator units when they are operating simultaneously. The components of the outdoor section also are capable of operating with less than all of the evaporator units in operation.

The indoor units 20 generally are of a conventional design and include an expansion device 22, heat exchanger tubing 24, and a fan and motor 26 to circulate air from the room across the heat exchanger tubing 24. As will be described in more detail below, the evaporator unit of the present invention also includes an automatically operated close off valve 28 placed in the heat exchanger tubing 24 at a position intermediate the expansion device 22 and the end 29 of the coil. The close off valve 28 can be a solenoid valve, a stepper motor valve, a motorized valve, a pilot operated valve, a pneumatically operated valve, or similar valves which can be opened and closed according to control signals. In the preferred embodiment, valve 28 is a solenoid valve.

The control for the multizone system is provided by a central control, referred to generally as 30, which includes logic switching elements such as relays or microprocessor 34, thermostats 32, the electrical control components of valve 28, control elements associated with the outdoor fan and compressor, control elements associated with the indoor fans, and wiring interconnecting the various working components of the system. In FIG. 1, all of the elements of the control system are shown, except the wiring. In FIG. 2, the connection of the elements are diagrammatically illustrated. The elements of the control system and the principles of the control are conventional ones known to persons skilled in the art.

In. FIG. 1, two evaporator units 20 are shown, while in FIG. 2 three evaporator units are shown. The present invention can include a plurality of individual evaporator units, each of the individual units having a capacity to match the cooling or heating requirements of the particular rooms or areas in which they are placed. The capacity of the outdoor unit, which can have a single or several compressors and condensers, is then sized to meet the capacity of the indoor units.

In accordance with the invention, the present invention includes a multizone air conditioning system for cooling multiple zones by circulating refrigerant in a closed circuit through the system. As shown, the system includes at least one compressor unit 12 for compressing the refrigerant to a high pressure. The system also includes one condenser unit 14 for cooling the refrigerant to a temperature below which the refrigerant becomes a liquid refrigerant, the condenser 14 being in fluid connection with and downstream from the compressor 12. The system also includes a plurality of evaporator units 20 placed in parallel relationship with one another in the circuit and in fluid connection with and downstream from the condenser. As shown, each individual evaporator unit 20 includes at least one expansion device 22, tubing 24 downstream of the expansion device, and an output end 29 in fluid connection with the compressor 12. The indoor units 20 are connected at one end with the condenser and at the other end with the compressor by conventional pipes or tubing, as is well-known in the art.

The control system 30 serves to activate and deactivate at least one of the individual evaporator units 20 so that refrigerant flows through the evaporator unit when activated and does not flow through the evaporator unit when it is deactivated. In addition, when an evaporator unit is deactivated, the fan motor 26 may be shut off.

In accordance with the invention, the present invention includes means for retaining within a portion of the tubing of an individual evaporator, when and if it is deactivated, an amount of refrigerant that is approximately equal to the amount of refrigerant in said individual evaporator unit, when it is activated. As a result, the refrigerant in said system remains balanced regardless of whether individual evaporator units are activated or deactivated. As shown in the preferred embodiment, the means for retaining includes solenoid valve 28 which is placed in the tubing 24 of an individual evaporator unit downstream of the expansion device 22.

Figure 4:
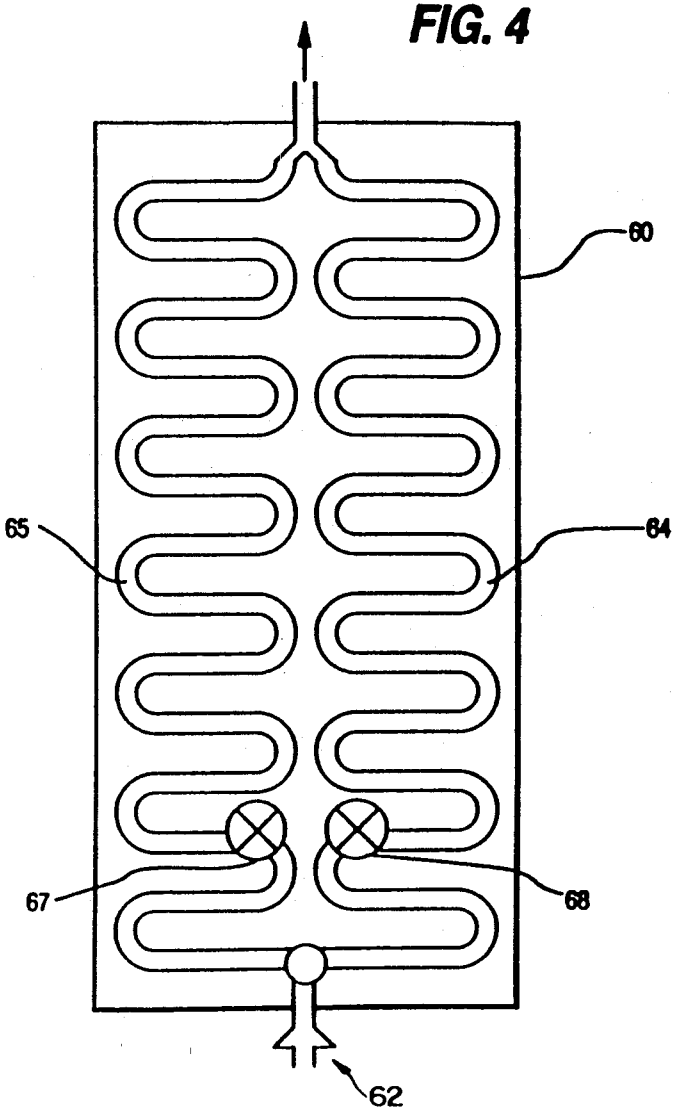
FIG. 4 is a schematic illustration of a second embodiment of an evaporator unit made according to the present invention.
Figure 3:
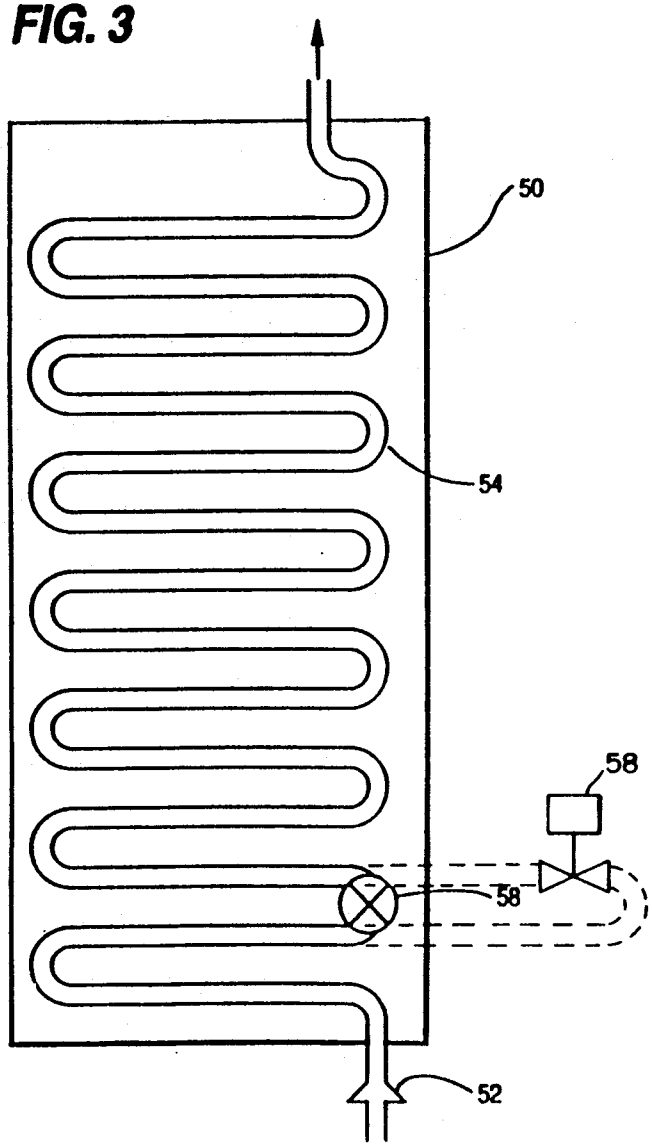
FIG. 3 is a schematic illustration of a first embodiment of an evaporator unit made according to the present invention.

Specific embodiments of an evaporator unit made in accordance with the present invention are disclosed in FIGS. 2 and 4. Referring to FIG. 3, evaporator unit 50 includes an expansion device 52, a single coil of tubing 54 and a single solenoid valve 58. In the preferred embodiment, the volume of tubing between the expansion device 52 and the solenoid valve 58 is approximately 10–20% of the total volume of the tubing in the individual evaporator unit. When the solenoid valve is placed in this position, the closure of the solenoid valve 58 will result in the tubing upstream of the solenoid valve 58 filling with liquid refrigerant, since the pressure will now be equalized to the condenser unit 14. The amount of liquid refrigerant upstream of the solenoid valve, when the device is deactivated, is approximately equal to the amount of refrigerant that would be in the evaporator unit when it is activated. For each particular system, persons skilled in the art through calculation and empirical testing can determine the optimum positioning of the solenoid valve for that particular system. In most applications, however, the solenoid valve should be placed within the first 25% of the length of the tubing in the evaporator unit.

Referring to FIG. 4, the evaporator unit 60 includes an expansion device 62 and two separate and parallel lines of tubing 64 and 65. Each separate line of tubing includes its own separate solenoid valve 67 and 68, and the solenoid valves are preferably positioned so that the volume of the tubing between the expansion device and the solenoid valves is approximately 10–20% of the total volume of the tubing in the individual evaporator units. As previously discussed, the particular placement of the solenoid valve can be varied for a particular system.

FIGS. 3 and 4 are diagrammatic illustrations of the evaporator coils and valves, those figures showing the solenoid valves 58 to be inside the evaporator units and positioned proximate return bends in the evaporator coil. In actual production, the solenoid valves preferably will be positioned in straight sections of the tubing. Moreover, for certain designs it may be preferable to position the solenoid valve external to the evaporator unit (as shown in dotted lines in FIG. 3) to make it easier to install the valve and attach it to the control system.

In the operation of the present system, the thermostats 32 are set in the individual zones at the temperature desired in those zones. For instance, one zone might be the bedroom of a residence, while the other zone might be the general area of the remaining portions in the house. The resident might wish that the temperature in the two zones be different at all times, or on the other hand might wish to conserve energy by allowing the areas outside the bedroom to be kept at a higher temperature during the evening, while keeping the bedroom cooler. In any event, whenever a thermostat 32 associated with a particular zone and evaporator unit determines that the desired temperatures has been met, that information is supplied to the indoor unit 20 of that zone which in turn causes the evaporator unit to become deactivated. The zone is deactivated by causing the solenoid valve 28 of that unit to close. As a result, the area between the expansion device 22 and the solenoid valve 28 becomes filled with liquid refrigerant from condenser 14, and the amount of liquid refrigerant in this closed space is equal or approximately equal to the amount of refrigerant that would exist in the evaporator unit when it is activated. As a result, the entire system remains balanced, regardless of whether one or more individual evaporator units are on or off. As a result, the system does not require a bleed-off systems or holding tanks whenever a unit is deactivated.

As described above, in the preferred embodiment the individual thermostats 32 control the solenoid valve 28 and the fan motor 26 of the individual units. The thermostat also is connected to the control 34 and thereby provides the control 34 with a signal indicating whether the individual units are active or deactive. The control 34 causes the outdoor unit to operate only when one or more of the evaporator units 20 are activated.

When the temperature exceeds the required temperature in a zone which has been deactivated, the thermostat 32 provides information to the control 34 which assures operation of the outdoor unit 10. The thermostat 32 also reactivates the individual unit in that zone, and the refrigerant therefore flows through the unit and returns to its ordinary steady flow conditions.

Several embodiments of the present invention are contemplated. For example, referring to FIG. 1, the system in its simplest form could include a single compressor having a single capacity and two separate evaporator units each having a capacity which is approximately equal to the capacity of the compressor. In such a system, the compressor would operate at one speed and capacity, whenever one or both zones requested cooling. The resultant system therefore would not require any complex control of the compressor.

In another embodiment, the compressor might be a twospeed and thus dual capacity compressor, and the total capacity of the compressor at high speed would be approximately equal to the total capacity of the individual evaporator units in the system. The individual evaporator units could either have the same or different capacities. The capacity of the compressor at the lower speed would be approximately equal to the lowest capacity of the individual evaporator units, to provide a good system balance.

In another embodiment, the system would include a multispeed, variable capacity compressor in which the capacity of the compressor could be controlled by the controller to approximately match the capacity being called for by the activated evaporator units at any given time. The operation and control of a variable compressor is well known in the art.

As can be seen from the above description, this invention describes a system for maintaining proper refrigerant charge by shutting off the evaporator at a point intermediate the ends of the evaporator coil. The system is originally designed so the refrigerant charge is determined according to components and the length of tubing in the application. When an evaporator is activated, the charge in the evaporator will be a two phase mixture. The weight of the refrigerant in the coil can be determined for normal operation by closing quick closing valves at the coil inlet and outlet and evacuating and weighing the amount of refrigerant. The solenoid is placed at a point in the evaporator coil such that the volume of liquid refrigerant tubing between the expansion device and the solenoid valve will be equal to the volume of refrigerant in the entire coil when the coil is activated and refrigerant is flowing in a two-phase mixture. When an evaporator coil is turned off at the solenoid valve, the volume in the evaporator coil upstream of solenoid valve will equalize at a high pressure and refrigerant will condense to fill the entire space. The amount of refrigerant in the coil will remain generally the same, whether it is activated or deactivated, and this constant amount of refrigerant in the evaporators will maintain a proper balance of refrigerant for the rest of the system.

The present invention, by providing balanced refrigerant charge, represents a significant improvement over the prior art. If the refrigerant charge is not retained in an idle evaporator unit, the refrigerant in the evaporator from its outlet back to the liquid close off valve of conventional systems will evaporate and flow to the compressor, from which it will condense when discharged to the condenser. In conventional systems, the liquid line close off valve of an evaporator is usually located upstream from the expansion device. Since the other operating evaporators already have adequate refrigerant, the excess will flow back to the compressor, unless an accumulator or other liquid storage devices are provided in the system. Liquid floodback to the compressor will greatly shorten its life and will also deteriorate the capacity of efficiency of the compressor. The present invention overcomes these problems without the need for complicated accumulators or similar devices. In addition, the present invention is economical, since the automatically operated solenoid valve makes it unnecessary to use the liquid line close off valve required in conventional systems to inactivate an evaporator coil.

The evaporator unit made according to the present invention can be produced as a standard, off the shelf evaporator unit which can be added to conventional air conditioning system. The solenoid valve of the evaporator unit can be controlled by a microprocessor or a thermostat to open and close the coil at the same time that the fan motor of the indoor unit is turned on and off.

It will be apparent to those skilled in the art that various modifications can be made in the multizone system of the present invention and in the construction of this invention without departing from the scope or spirit of the invention. As an example, although the present invention has been described as a multizone air conditioning system, the present invention could equally be applied to a multizone heat pump/air conditioning system. In such a system, each evaporator coil would then include two solenoid valves positioned at opposite intermediate ends of the coil according to the principles of the invention previously described.

Other embodiments of the invention will be apparent to those skilled in the art from a consideration of the specification and practice of the invention disclosed herein. It is intended that the specification and examples be considered as exemplary only, with the full scope and spirit of the invention being indicated by the following claims.

What is claimed is:

1. A multizone air conditioning system for cooling multiple zones by circulating refrigerant in a closed circuit through the system, the system comprising:

at least one condensing unit containing a compressor and a condenser for condensing the refrigerant from a vapor to a liquid refrigerant, said condenser being in fluid connection with and downstream from said compressor;

a plurality of evaporator units placed in parallel relationship with one another in the circuit and in fluid connection with and downstream from said condenser, each individual evaporator unit including at least one expansion device, heat exchange tubing having an input end downstream from said expansion device, and an output end in fluid connection with said compressor;

control means for activating and deactivating at least one individual evaporator unit so that refrigerant flows through said evaporator unit when it is activated and does not flow through said evaporator when it is deactivated; and means including at least one automatically operated close off valve located in the heat exchange tubing of an individual evaporator unit between said input and output ends for retaining within a portion of the heat exchange tubing of an individual evaporator, when and if it is deactivated, an amount of liquid refrigerant that is, when evaporated, approximately equal to the amount of refrigerant that is in the individual evaporator unit when it is activated, whereby the refrigerant in each individual evaporator unit of the system remains essentially the same regardless of whether individual evaporator units are activated or deactivated.

2. The multizone air conditioning system of claim 1 wherein said control means includes means for closing said automatically operated close off value to thereby prevent the flow of refrigerant through the heat exchange tubing of the individual evaporator unit and cause the refrigerant upstream of said solenoid valve to condense.

3. A multizone air conditioning system of claim 2 wherein said volume of heat exchange tubing between said expansion device and said at least one automatically operated close off valve is less than 25% of the total volume of said tubing in said individual evaporator unit.

4. The multizone air conditioning system of claim 1 wherein the total capacity of the compressors in the system is approximately equal to the total capacity of said individual evaporator units in the system.

5. The multizone air conditioning system of claim 1 wherein the total capacity of the individual evaporator units in the system exceeds the total capacity of the compressors in the system.

6. The multizone air conditioning system of claim 1 wherein each individual evaporator unit includes two or more heat exchange tubes in parallel and wherein an automatically operated close off value is placed in each tube of said evaporator unit downstream of said expansion device.

7. The multizone air conditioning system of claim 1 wherein said control means includes means for sensing the temperature in each zone associated with an individual evaporator unit and closing the automatically operated close off valve in an individual evaporator unit when the sensed temperature goes below a predetermined temperature.

8. The multizone air conditioning system of claim 1 wherein said compressor unit has a variable capacity.

9. The multizone air conditioning system of claim 8 wherein said control means includes means for approximately equating at any time the capacity of said compressor with the capacity of the individual evaporator units which are activated.

10. An evaporator unit for use in a multizone air conditioner system in which refrigerant flows through said evaporator unit when it is in active operation, the evaporator unit comprising;

at least one expansion device;

an evaporator coil downstream of and in fluid communication with said expansion device, said evaporator coil including elongated tubing; and valve means placed in said tubing of said evaporator coil at a position intermediate the length of said tubing for retaining within the portion of the tubing downstream of said expansion device and upstream of said valve means an amount of liquid refrigerant that is, when evaporated, approximately equal to the amount of refrigerant which will occupy the evaporator when it is in active operation in the multizone air conditioning system.

11. The evaporator unit of claim 10 wherein said valve means is an automatically operated close off valve.

12. The evaporator unit of claim 11 wherein the volume of tubing between said expansion device and said automatically operated close off valve is less than 25% of the total volume of said tubing in said evaporator unit.

13. The evaporator unit of claim 10 wherein the evaporator unit includes two or more tubes in parallel and wherein said valve means includes an automatically operated close off valve placed in each said parallel tube downstream of said expansion device.

14. The evaporator unit of claim 13 wherein the volume of tubing upstream of said automatically operated close off valves is less than 25% of the total volume of tubing in said evaporator unit.

* * * * *

UNITED STATES PATENT AND TRADEMARK OFFICE

CERTIFICATE OF CORRECTION

PATENT NO. : 5,077,982

DATED : January 7, 1992

INVENTOR(S) : Jacob E. Shaffer, Jr.

It is certified that error appears in the above-identified patent and that said Letters Patent is hereby corrected as shown below:

Claim 2, column 8, line 12, change "value" to --valve--.

Claim 6, column 8, line 34, change "value" to --valve--.

Signed and Sealed this

Twenty-second Day of June, 1993

*Attest:*

Michael K. Kirk

MICHAEL K. KIRK

*Attesting Officer*

*Acting Commissioner of Patents and Trademarks*